US005335736A

United States Patent [19]

Windsor

[11] Patent Number: 5,335,736

[45] Date of Patent: Aug. 9, 1994

[54] ROCK BOLT SYSTEM AND METHOD OF ROCK BOLTING

[75] Inventor: Christopher R. Windsor, Cottesloe, Australia

[73] Assignee: Commonwealth Scientific and Industrial Research Organisation, Campbell, Australia

[21] Appl. No.: 956,898

[22] PCT Filed: Jul. 16, 1991

[86] PCT No.: PCT/AU91/00315

§ 371 Date: Jan. 26, 1993

§ 102(e) Date: Jan. 26, 1993

[87] PCT Pub. No.: WO92/01859

PCT Pub. Date: Feb. 6, 1992

[30] Foreign Application Priority Data

Jul. 17, 1990 [AU] Australia ..... PK1221/90

[51] Int. Cl.[5] ..... E21B 7/00

[52] U.S. Cl. ..... 175/57

[58] Field of Search ..... 175/57; 405/259–261

[56] References Cited

U.S. PATENT DOCUMENTS 2,757,906 8/1956 Ryd ..... 175/57

4,312,604 1/1982 Fu et al. .

FOREIGN PATENT DOCUMENTS 545968 3/1982 Australia .

552242 4/1983 Australia .

576157 12/1986 Australia .

2741106 3/1979 Fed. Rep. of Germany .

*Primary Examiner*—Thuy M. Bui

[57] ABSTRACT

A rock bolt system comprises an inner part (1) disposed within an outer part (10). The inner part comprises an elongated tube having an axial depression (2) and an internal pressure fluid receiving chamber (4) which is closed at both of its ends. A fluid inlet communicates with the fluid receiving chamber. The outer part (10) comprises an elongated tube having a longitudinal slot (12), which slot extends at least part way along the length of the outer part tube. In use, the rock bolt system is placed in an oversized borehole (20) and pressurized fluid applied to the fluid receiving chamber. This causes the device to expand laterally and engage the walls of the borehole.

8 Claims, 3 Drawing Sheets

Comparison of Axial Testing

Comparison of Shear Testing

ROCK BOLT SYSTEM AND METHOD OF ROCK BOLTING

FIELD OF THE INVENTION

This invention relates to a rock bolting system. The invention is also concerned with a method of rock bolting.

DESCRIPTION OF THE BACKGROUND ART

There is a large number of rock bolt devices commercially available for installation within boreholes drilled into rock. These have a variety of general and special uses as rock reinforcement in both civil and mining engineering. One particular class of these devices is known as "Friction Rock Stablisers". These devices are usually compressed or expanded to fit the borehole and consequently achieve their reinforcing ability by virtue of friction (and to some extent mechanical interlock) at the interface between their outer surface and the borehole wall. These devices include the "Swellex", the "Split Set", the "Pipe Bolt" and the "Rock Nail".

"Swellex" bolts were introduced into Australia in approximately 1984. The bolt is described in Australian Patent Application no. 545968 and essentially comprises an elongated tube which has an axial depression and an internal pressure fluid receiving chamber which is closed at both ends but has a fluid inlet at one end thereof. The bolt may also comprise a fixed sleeve on one end of the tube which is the outer end of the tube, the sleeve and tube having a hole there through to communicate with the internal chamber of the tube so that the hole forms the fluid inlet. When the device is installed in an oversize bore hole and fluid is injected through the inlet the inflation pressure causes both the steel tube and to a lesser extent, the rock to expand. When the pressure is released, the rock relaxes and an interface pressure is established between the steel tube and the rock surface. Resistance to pull-out is caused by friction and mechanical interlock between the steel tube and the rough borehole wall.

A consistent and quality assured installation is the primary requirement for all rock reinforcement systems. This prerequisite is assured for the "Swellex" bolt by an elegant insertion and inflation procedure. Furthermore, this simple procedure does not require high operator expertise. However, the mechanical properties of the installed "Swellex" can be improved to address the fundamental modes of action required of rock reinforcing systems. That is, modification to the axial and shear strengths and stiffnesses.

Another form of stabilising device is the "Split Set" bolt. The "Split Set" bolt has been used in Australia since the 1970's. The Split Set bolt comprises a split tube formed from a hot-rolled steel sheet of a certain thickness which is formed in a tube rolling mill. Instead of closing the tube a longitudinal slot is left open. The split tube is cut to length, one end is tapered and a formed ring is welded to the opposite end. The tapered end allows forced insertion into an undersized borehole. The ring is intended to support a face plate at the borehole collar. In use, the "Split Set" bolt is driven into the bore hole, compressing the split tube and causing an interfacial pressure between the bolt and the rock. Resistance to pull out is due mainly to friction.

The ideal rock reinforcement device is one in which the design capacity is achieved at an appropriate stiffness without rupture of the element, irrespective of displacement. To achieve this, slip must occur between one or more of the constituent interfaces between the device and the host rock. That is, an ideal bolt may be loaded to a design load prior to slip and that a substantial proportion of this load is maintained during subsequent slippage.

The "Split Set" bolt described above goes some way towards this ideal. Slippage can occur for large displacements without rupture occurring. However, its frictional anchoring capacity is usually significantly less than its axial strength. To increase anchoring capacity a smaller bore hole may be used. However, this makes installation difficult if not impossible.

The "Swellex" bolt has the potential to achieve the stated aims of an ideal device. This could be achieved by reducing the installation pressure. However, reduction of installation pressure results in unpredictable performance. Thus, the great advantage of a consistent high quality installation is lost.

DISCLOSURE OF THE INVENTION

The prime objective of the present invention is to provide a rock bolt system and a method for installing rock bolts which overcome, or at least mitigate, some of the problems with the previously described rock bolts.

Accordingly, in one aspect, there is provided a rock bolt system comprising an inner part disposed within an outer part, said inner part comprising a fluid expansible elongated tube having an internal closed ended fluid receiving chamber having a fluid inlet, said outer part comprising an elongated tube having a longitudinal slot, said slot extending at least part way along the length of said tube of said outer part.

In a second aspect, the present invention provides a rock bolt system comprising an inner part disposed within outer part, said inner part comprising an elongated tube having an axial depression and an internal pressure fluid receiving chamber which is closed at both of its ends and having a fluid inlet communicating with said fluid receiving chamber, said outer part comprising an elongated tube having a longitudinal slot, said slot extending at least part way along the length of said tube of said outer part.

In a further aspect, the present invention provides a method for rock bolting said method comprising providing a rock bolt system within a borehole, said rock bolt system comprising an inner part disposed within an outer part, said inner part comprising a fluid expansible elongated tube having an internal closed ended fluid receiving chamber having a fluid inlet, said outer part comprising an elongated tube having a longitudinal slot, said slot extending at least part way along the length of said tube of said outer part, supplying fluid under pressure to said fluid receiving chamber through said fluid inlet to expand said expansible tube and expand said slotted tube in said borehole.

The inner part may be an Atlas Copco standard "Swellex" bolt.

Preferably, although not necessarily, after expansion the aperture in the outer tube is diametrically opposite to the depression in the inner tube.

This invention relates to a new and additional device which, at first glance would appear to comprise simply coupling the "Swellex" with the "Split Set". Although these two devices are particularly relevant to this invention the fundamental mechanics of installation and operation of the present invention are markedly different from that of either individual or coupled use of the "Swellex" and the "Split Set".

The rock bolt system of the present invention has four principal attributes. Two are concerned with its installation into boreholes and two are concerned with its operation as a reinforcement system. In terms of installation the invention maintains the advantages of the original "Swellex":

ease of insertion in the borehole, combined with quality assured installation.

In terms of operation it provides:

flexibility of design configuration, together with optimum use of material properties as reinforcement.

The aim of the present invention is to provide a reinforcement assembly which may be arranged to supply the required axial and shear capacities and stiffnesses to suit different modes of operation demanded of reinforcement systems. For example this may be achieved by varying:

the outer tube geometry (i.e. profile, length, diameter, thickness, slot length)

the outer tube properties (i.e. material type, constitutive behaviour, coefficient of friction)

the inflation agent and procedure (pressure, fluid type and method)

the interface between the inner and outer components (lubricated or rough interface may be arranged). Similarly the longevity and corrosivity and suitability to different environments may be arranged by judicious choice of insertion fluid agents and constituent component material types and coatings.

The invention is preferably used in the same nominal sizes as the "Swellex" and the "Split Set" bolts and is also compatible with current drilling and installation machinery. This is currently limited to devices to suit approximately 38 mm to 40 mm and approximately 44 mm to 46 mm diameter boreholes and in lengths ranging from approximately 1 m to 4 m. Clearly, the rock bolt system of the invention is not limited by size and is equally applicable in larger or smaller diameters and lengths.

In order that the invention may be more fully understood we provide the following non-limiting examples.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
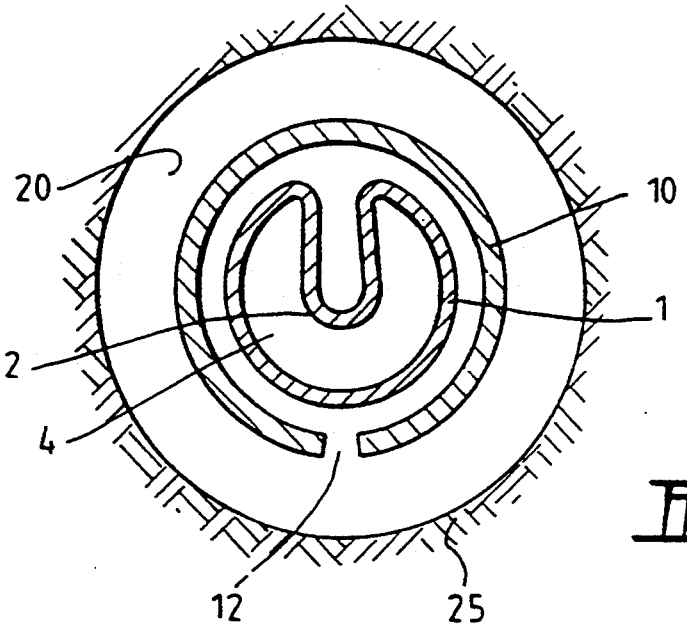
FIG. 1 shows a cross-sectional view of a rock bolt system in accordance to the invention prior to expansion.

The most basic form of the invention is shown in FIG. 1. The rock bolt system comprises an inner tube 1 (which may be a "Swellex" bolt P.A. No. 545968).

DETAILED DESCRIPTION OF THE PREFERRED EMBODIMENTS

The invention will now be described in reference to the use of a "Swellex" bolt as the inner tube 1, however the invention is not to be seen as limited to the use of this bolt.

The "Swellex" bolt 1 is located within a second outer tube 10 which has a longitudinal slot 12. It will be seen from the drawing that the axial depression 2 of the "Swellex" bolt is located diametrically opposite the aperture 12 of the outer tube. The first tube ("Swellex" bolt)—second tube combination is located within borehole 20 of rock 25. The outer tube may be tapered at one end to facilitate insertion into the borehole. Expansion is achieved by supplying high pressure liquid to the inner "Swellex" bolt. In the process of expansion the inner "Swellex" bolt eventually comes into contact with the outer split tube effecting expansion of the outer split tube against the walls of the borehole.

Figure 2:
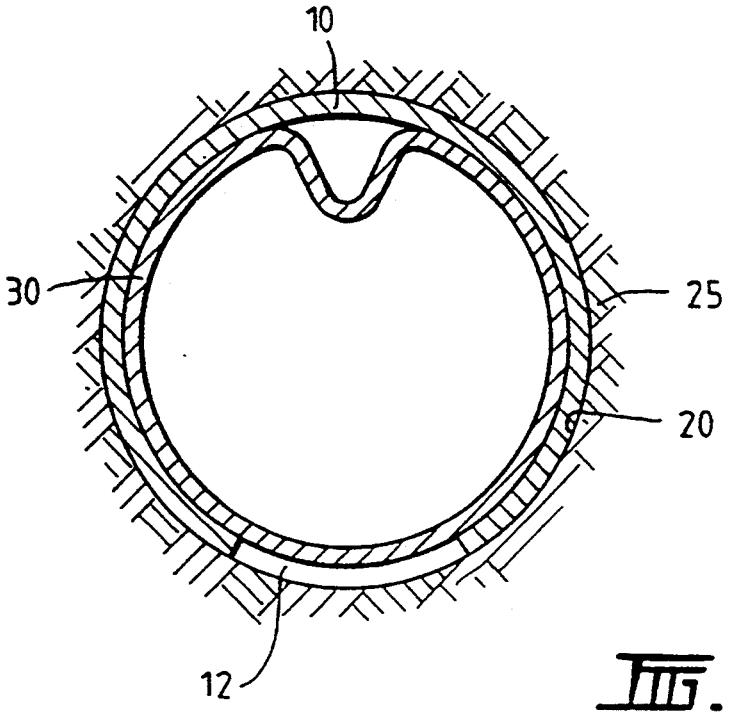
FIG. 2 shows a cross-sectional view of a rock bolt system in accordance with the invention after expansion.

FIG. 2 shows the bolting system of the invention after expansion of the inner "Swellex" bolt 30.

Whilst the outer tube adds to the apparent stiffness of the bolt, it should be noted that the axial stiffness is also affected by the rate of load transfer from the rock to the outer tube and from this tube to the inner "Swellex" bolt.

A laboratory testing program has been undertaken to quantify some of the differences in response between the standard "Swellex" bolt and two variants of the bolt according to the invention.

Reinforcing devices are designed to reinforce discontinuities such as pre-existing joints or propagating cracks. They attempt to control the opening and shearing displacements that can occur at these discontinuities. The laboratory tests were designed to simulate these two aspects of reinforcement loading, discontinuity opening or tensile loading and discontinuity shearing or shear loading.

The standard "Swellex" bolt manufactured to suit 38 mm to 40 mm diameter boreholes was chosen for testing. Preferred bolt variants according to the invention comprise an inner standard "Swellex" bolt with an outer split tube sleeve. In the first variant of the invention, the outer sleeve comprised a 31.8 mm diameter, 1.6 mm wall thickness steel tube. In the second variant, the outer sleeve comprised a 35.0 mm diameter, 3.2 mm wall thickness steel tube.

TESTING ARRANGEMENTS

In all cases the specimens were installed within 40 mm internal diameter, 17.5 mm thick walled steel containment tubes. These very thick and rigid containment tubes were designed to duplicate the radial confinement supplied by an average rock. The containment tubes are made up of two tube lengths butted together. The reinforcement device is inserted into the tube to span this butt joint and then inflated. Once inflated the butt joint is used to simulate a discontinuity by forcing the specimen to extend or shear at this interface. This arrangement of the specimen containment tubes was compatible with both the axial and the shear testing facilities.

Discontinuity opening or tensile loading was simulated by securing the two containment tubes and pulling them apart, thereby inducing tension in the reinforcing device at the test interface. The containment tubes were secured by a universal testing machine approximately 500 mm either side of the test interface. The variables measured included the load supplied by the machine and the axial displacement at the test interface.

Discontinuity shearing or shear loading was simulated by placing the test specimen in a shear facility. The facility is placed within a universal test machine which supplies a shearing force at the test interface. The transverse movement of one containment tube relative to the other side of the test interface causes shearing of the specimens. The variables measured included the shear load supplied by the machine and the shear displacement at the test interface.

RESULTS AND COMPARISON

A set of axial tension test was performed to determine whether the behavior of standard "Swellex" bolts installed in thick walled steel containment tubes was representative of their behavior in rock. The embedment length on one side of the test interface was held constant at relatively long length (1.5 m) and the embedment length on the other side of the test interface was varied. This arrangement allowed slippage from the short embedment length to be studied. The results summarised in Table 1 are in agreement with the performance expected of standard "Swellex" bolts installed in hard rock. The strength increases as the embedment length increases and failure is by slippage of the "Swellex" bolts installed in hard rock. The strength increases as the embedment length increases and failure is by slippage of the "Swellex" from within the containment tube. Although failure at the longer embedment lengths was by slippage, the yield strength of the "Swellex" bolt material was exceeded.

TABLE 1

Summary of Laboratory Tension Tests

| Long Embedment (m) | Short Embedment (m) | Peak Load (kN) |
|---|---|---|
| 1.5 | 0.50 | 80 |
| 1.5 | 0.75 | 100 |
| 1.5 | 1.00 | 110 |
| 1.5 | 1.25 | 120 |

Figure 3:
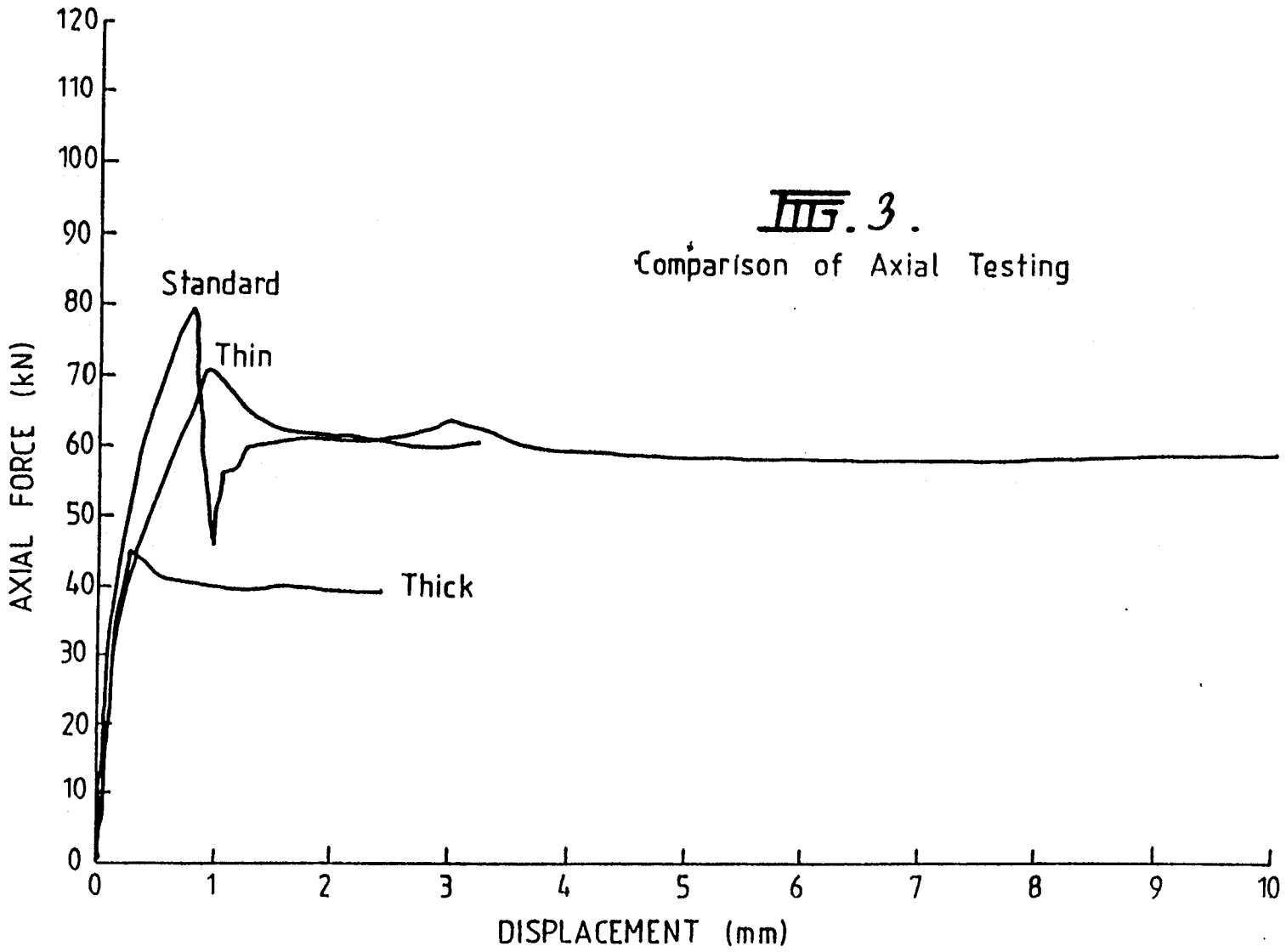
FIG. 3 is a graph showing axial test results.
Figure 4:
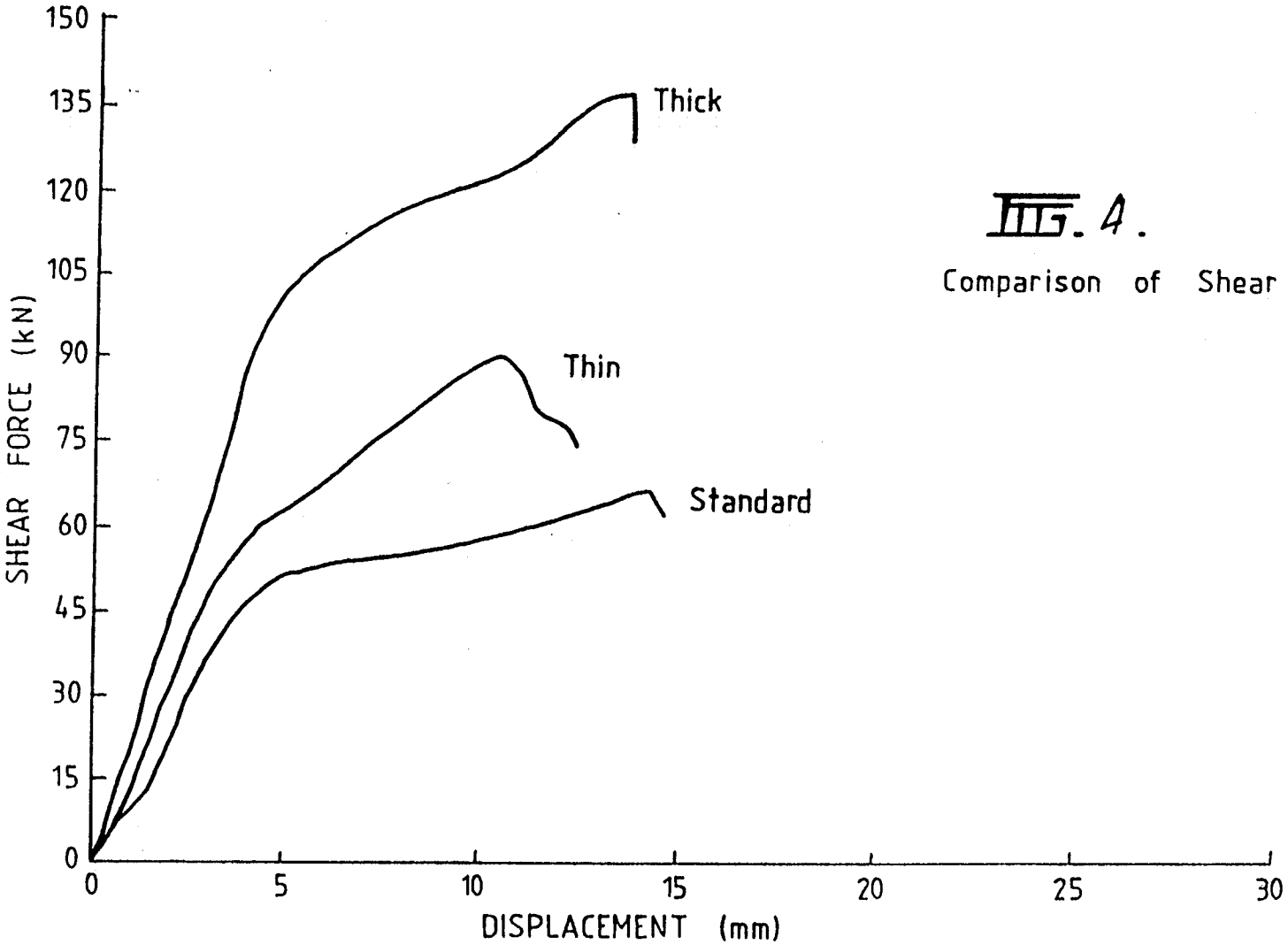
FIG. 4 is a graph showing shear test results.

A series of tests was designed to compare the performance of rock bolts according to the invention with the standard "Swellex" in both axial tension and shear. The results for axial tension tests are summarised in FIG. 3 and the results obtained in the shear tests are summarised in FIG. 4.

These results demonstrate that:

axial load transfer decreases as the split tube thickness increases shear strength increases as the outer split tube thickness increases.

These results show that the bolt of the invention can be arranged to achieve a range of axial load transfer and shear strengths. This ability is consistent with the requirements of a variety of reinforcement applications for excavations in jointed rock. This range of mechanical properties can be achieved whilst maintaining a consistent and quality assured reinforcement installation.

In practice, reinforcement devices are subject to combined axial and shear loading caused by opening and shear of the discontinuities which they reinforce. It is therefore particularly important that bolts of the invention have a high shear strength combined with adequate resistance to axial loading.

The preliminary tests have used a standard "Swellex" bolt for inflation and outer split tubes made from steel. This has dictated the range of sizes used for the bolts. It will be appreciated however that the size of the bolt will not be limited to these sizes and the outer tube may be made from a range of materials consistent with the requirements of the application.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

The claims defining the invention are as follows:

1. A rock bolt system comprising an inner part disposed within an outer part, said inner part comprising a fluid expansible elongated tube having an internal closed ended fluid receiving chamber having a fluid inlet through which the expansible tube can be pressurized to permanently expand radially, said outer part comprising an elongated tube having a longitudinal slot, said slot extending at least part way along the length of said tube of said outer part.

2. A rock bolt system comprising an inner part disposed within an outer part, said inner part comprising an elongated tube having an axial depression and an internal pressure fluid receiving chamber which is closed at both ends thereof and having a fluid inlet communicating with said fluid receiving chamber through which inlet the elongated tube can be pressurized to permanently expand radially, said outer part comprising an elongated tube having a longitudinal slot, said slot extending at least part way along the length of said tube of said outer part.

3. The rock bolt system as claimed in claim 2, wherein said inner and outer parts are oriented such that said axial depression is located substantially diametrically opposite said longitudinal slot.

4. A method for rock bolting comprising providing a rock bolt system within a borehole, said rock bolt system comprising an inner part disposed within an outer part, said inner part comprising a fluid expansible elongated tube having an internal closed ended fluid receiving chamber having a fluid inlet, said outer part comprising an elongated tube having a longitudinal slot, said slot extending at least part way along the length of said tube of said outer part, supplying fluid under pressure to said fluid receiving chamber through said fluid inlet to permanently expand said expansible tube in said borehole and thereby expand said slotted tube in said borehole.

5. The method for rock bolting as claimed in claim 4, wherein said inner part comprises an elongated tube having an axial depression and an internal pressure fluid receiving chamber which is closed at both ends thereof and having a fluid inlet communicating with said chamber.

6. The method for rock bolting according to claim 5, wherein said axial depression develops outwardly when fluid under pressure is supplied to said fluid receiving chamber to thereby laterally expand said expansible tube.

7. The method for rock bolting according to claim 5 or claim 6, wherein said fluid is pressurized water.

8. The method for rock bolting according to claim 5 or claim 6, wherein said inner and outer parts are oriented such that said axial depression is located substantially diametrically opposite said longitudinal slot.

* * * * *